United States Patent [19]

Fujita

[11] Patent Number: 4,571,017

[45] Date of Patent: Feb. 18, 1986

[54] ELECTRICAL CONNECTOR ASSEMBLY

[75] Inventor: Yukihisa Fujita, Matsudo, Japan

[73] Assignee: AMP Incorporated, Harrisburg, Pa.

[21] Appl. No.: 547,810

[22] Filed: Nov. 1, 1983

[30] Foreign Application Priority Data

Nov. 4, 1982 [JP] Japan ..... 57-166189[U]

[51] Int. Cl.[4] ..... H01R 11/11

[52] U.S. Cl. ..... 339/59 M; 339/60 M; 339/217 S

[58] Field of Search ..... 339/59 R, 59 M, 60 R, 339/60 M, 61 R, 61 M, 217 S

[56] References Cited

U.S. PATENT DOCUMENTS 4,127,314 11/1978 Hasimoto ..... 339/59 M

FOREIGN PATENT DOCUMENTS 1804945 12/1976 Fed. Rep. of Germany ... 339/60 M

*Primary Examiner*—Gil Weidenfeld
*Assistant Examiner*—Paula A. Austin
*Attorney, Agent, or Firm*—Gerald K. Kita

[57] ABSTRACT

An electrical connector assembly comprises a first connector having a first housing with spaced parallel side walls defining a terminal-receiving passageway therein and a terminal in the terminal-receiving passageway, the housing being provided with a resilient arm extending outwardly from one of the opposed inner surfaces of the side walls and projecting into the terminal-receiving passageway, the arm having a free end which is adapted to hold the terminal in the terminal-receiving passageway, and a second connector having a second housing with spaced side walls which can be fitted into the side walls of the first housing, the second connector having another terminal arranged between the side walls thereof to be electrically connected to the terminal of the first connector when the second connector is mated with the first connector, the resilient arm extends parallel to the associated side wall on which the resilient arm is formed and is spaced from the associated wall providing a space for receiving one of the side walls of the second housing between the associated wall and the resilient arm to limit the movement of the resilient arm in a direction away from the terminal when the second connector is mated with the first connector.

4 Claims, 4 Drawing Figures

ELECTRICAL CONNECTOR ASSEMBLY

FIELD OF THE INVENTION

The invention relates to an electrical connector assembly.

BACKGROUND OF THE INVENTION

In order to secure a terminal in a terminal-receiving passage of a connector housing, the general approach is to stamp out a resilient lance member from a section of the terminal which mates with an abutting surface in the passage of the connector housing. However, a terminal with such a lance member has a problem in that the lance member is prone to being damaged during handling of the terminal.

Therefore, in the latest connectors, another way of retaining a terminal in a terminal-receiving passage of a housing is employed. That is, a housing is provided with a resilient arm which is integrally formed in the housing and which extends obliquely from one of opposed wall surfaces of the terminal-receiving passage into the passage, the terminal without a lance member being retained in the passage by engaging with a free end of the resilient arm. However, the electrical connector with such resilient arm has a problem in that when a terminal is pulled by excessive force applied to an electrical wire which is connected to the terminal, the arm is possibly bent and deformed to disengage the terminal from the arm if the arm does not have sufficient terminal retention strength.

Especially, this is one of the problems involved in the construction of small-size connectors with resilient arms because, recently, connectors tend to be miniaturized and to limit the space of terminal-receiving passages so that the resilient arm has to be made small and thin; therefore, the terminal retention strength thereof is not sufficient.

SUMMARY OF THE INVENTION

In view of the aforementioned problem, an object of the present invention is to provide an electrical connector assembly which assures a sufficient terminal retention strength even in small-size connectors.

According to the present invention, an electrical connector assembly comprises a first connector having a first housing with spaced parallel side walls defining a terminal-receiving passageway therein and a terminal in the terminal-receiving passageway, the housing being provided with a resilient arm extending outwardly from one of the opposed inner surfaces of the side walls and projecting into the terminal-receiving passageway, the arm having a free end which is adapted to hold the terminal in the terminal-receiving passageway, and a second connector having a second housing with spaced side walls which can be fitted into the side walls of the first housing, the second connector having another terminal arranged between the side walls thereof to be electrically connected to the terminal of the first connector when the second connector is mated with the first connector, the resilient arm extends parallel to the associated side wall on which the resilient arm is formed and is spaced from the associated wall providing a space for receiving one of the side walls of the second housing between the associated wall and the resilient arm to limit the movement of the resilient arm in a direction away from the terminal when the second connector is mated with the first connector.

DETAILED DESCRIPTION OF THE INVENTION

Figure 1:
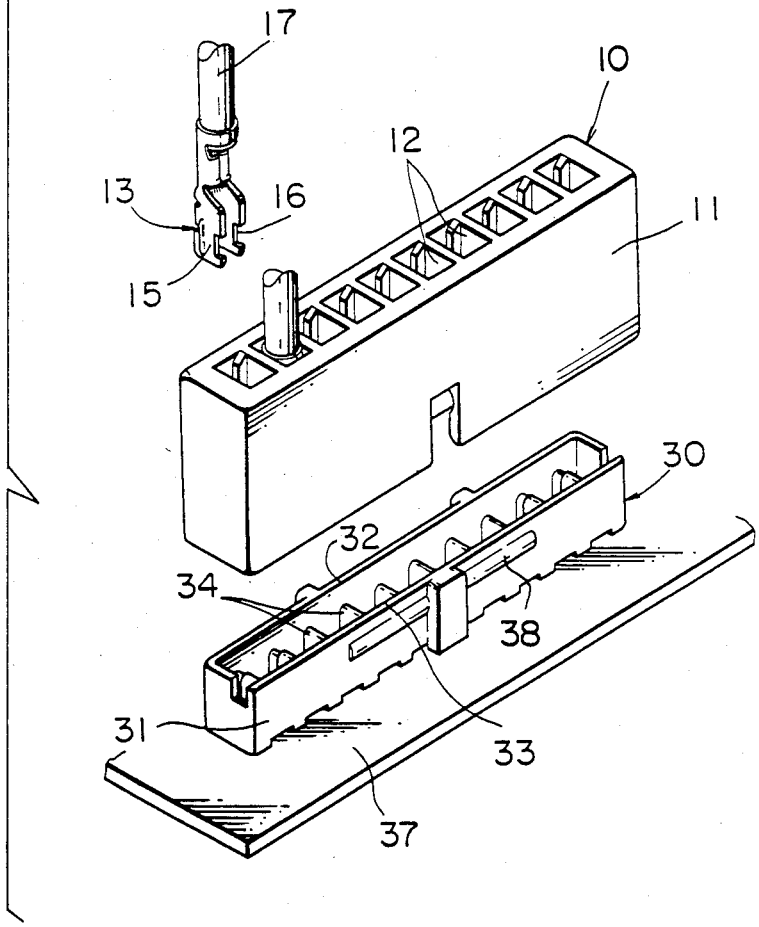
FIG. 1 is a perspective and exploded view of parts of an electrical connector assembly according to the invention.

The electrical connector assembly according to the invention comprises the first connector 10 which is a female member and the second connector 30 which is a male member.

The first connector 10 comprises the first housing 11 which is molded from electrically insulating material and has a plurality of terminal-receiving passageways 12 arrayed parallel to each other. An electrical terminal 13 is arranged in each of the terminal-receiving passageways 12 and is connected to an electrical wire 17.

Figure 2:
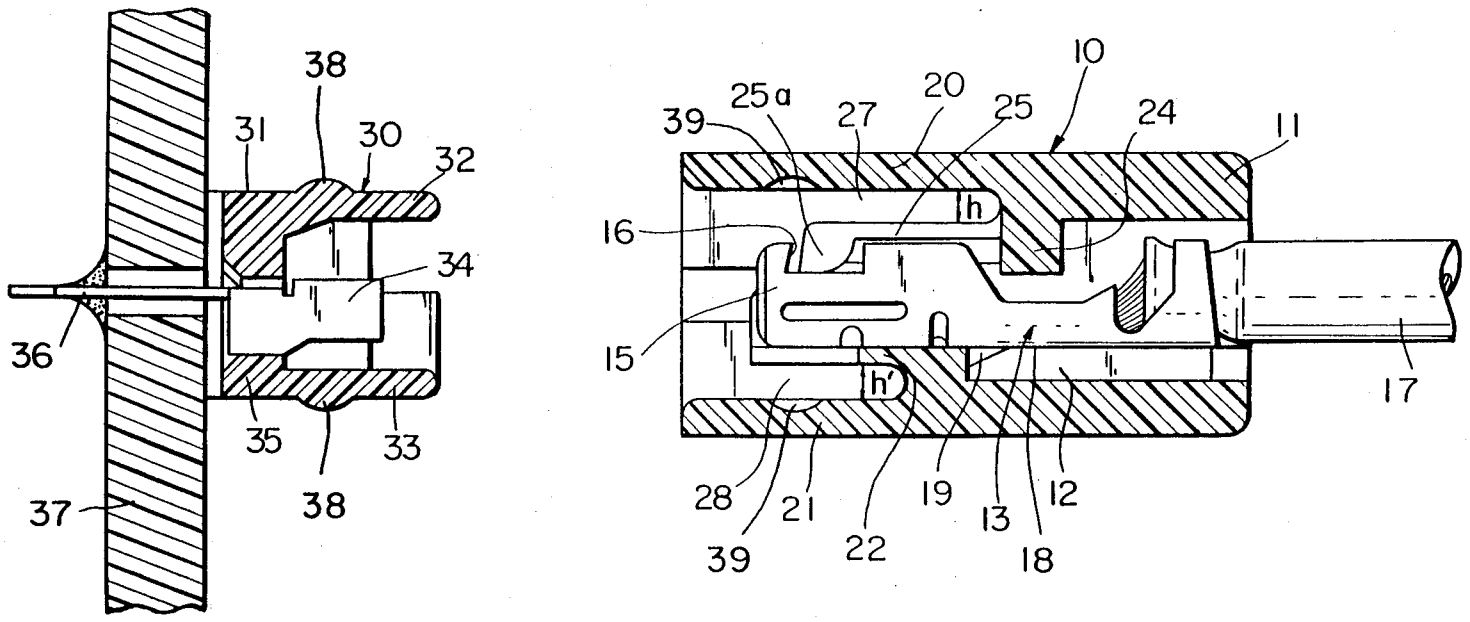
FIG. 2 is a cross-sectional view of the electrical connector assembly of FIG. 1.

As shown in FIG. 2, the first housing 11 has opposing side walls 20, 21 and an integral resilient arm 25 extending from a projection 24 on the side wall 20, the arm 25 being parallel to and spaced from the side wall 20.

A space 27 is provided between the lower surface of the side wall 20 (in FIG. 2) and the resilient arm 25 and is adapted to receive the side wall 32 of the second housing as described later, the height h of the space 27 being sized to permit the side wall 32 of the second housing to fit therein. The free end of the resilient arm 25 ends at about midway of the passageway portion forward of projection 24 and is provided with a latching projection **25*a*** on its inner surface.

A terminal-supporting member 22 extends from the other side wall 21 of the first housing and is parallel to and spaced therefrom. A space 28 is defined by the side wall 21 and the terminal-supporting member 22 and is adapted to receive the side wall 33 of the second housing, the height h' being sized to permit the side wall 33 to fit therein.

On the terminal-supporting member 22 is placed the substantially U-shaped contact section of terminal 13 which includes a pair of opposing contact arms 15 having free ends respectively. The upper forward portion (in FIG. 2) of each contact arm 15 is formed with a recess 16 which is engaged by the locking projection **25*a* of the resilient arm 25 thereby preventing the terminal from moving in the rightward direction in FIG. 2. Further, the bottom surface 18 of the terminal 13 is formed with a convex projection 19 which provides a perpendicular forward surface, the projection 19 engaging the rear surface of the terminal-support member 22 to limit the movement of the terminal in the direction of insertion of the terminal in the passageway 12. The second housing 31 is provided with the side walls 32 and 33 which are parallel to each other and respectively fit in the spaces 27 and 28 of the first housing 10, the two side walls 32, 33 containing therebetween terminal 34 which electrically mates with the contact section of terminal 13 in the first connector. The terminal 34 has a leg 36 and is secured in the base 35 of the second housing, the leg 36 passing through the base 35 and is connected to a circuit path on printed circuit board 37**.

Figure 3:
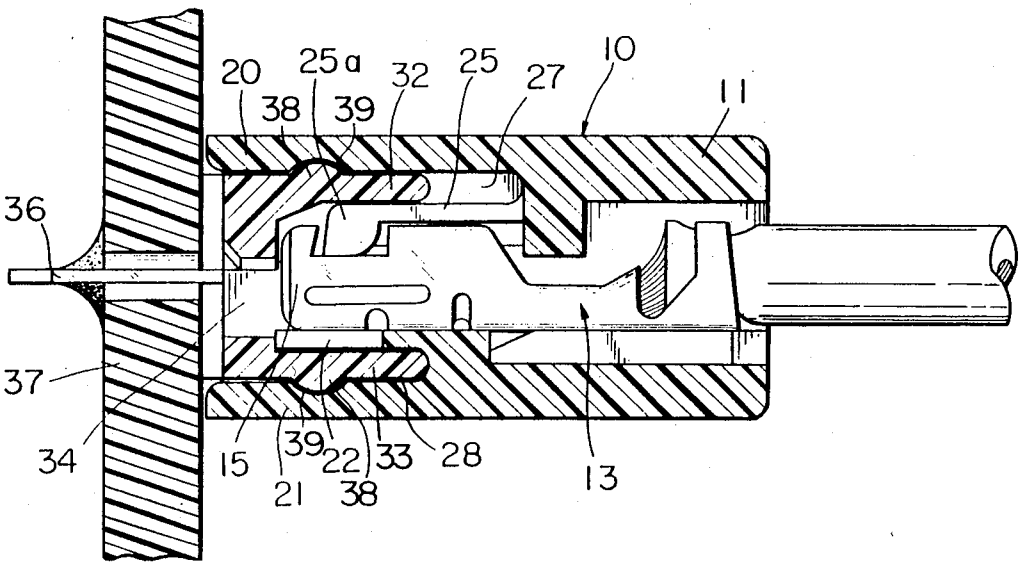
FIG. 3 is similar to FIG. 2 showing the assembled condition of the electrical connector.

As shown in FIG. 3, when the first connector 10 is mated with the second connector 30 to establish an electrical connection between the terminals 13 and 34, the side walls 32 and 33 of the second housing are fitted within the walls 20 and 21 of the first housing 11 and into the spaces 27 and 28 of the first housing respectively, the side wall 32 engaging with the inner surface of the side wall 20 and the outer surface of the resilient arm 25 and the side wall 33 engaging with the inner surface of the side wall 21 and the outer surface of the terminal support member 22 so that the resilient arm 25 is prevented from being deflected by the side wall 32. The outer surface of walls 32 and 33 include arcuate projections 38 that mate with respective arcuate recesses 39 in the inner surfaces of walls 20 and 21 to provide a latching arrangement between connectors 10 and 30 and to increase the retention forces on terminals 13.

Figure 4:
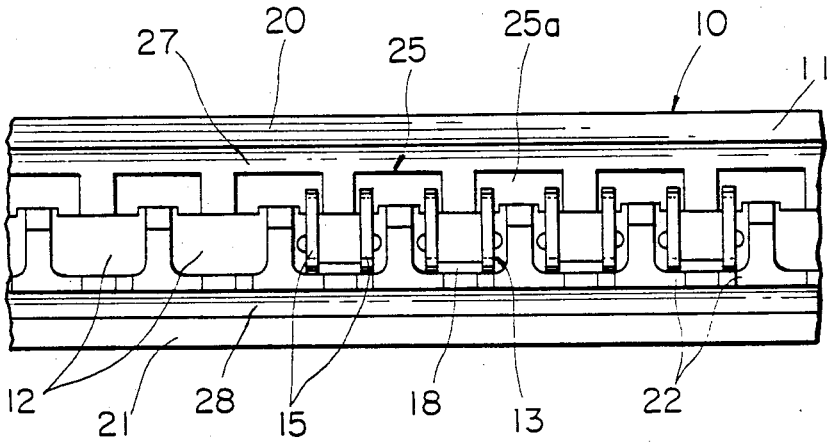
FIG. 4 is a front elevational view of part of the electrical connector of FIG. 1.

As shown in FIG. 4, latching projection 25*a* of each resilient arm 25 is disposed in recesses 16 of adjacent contact arms 15 of adjacent terminals 13.

According to the present invention as heretofore described and illustrated, a resilient arm, which retains a terminal in a first housing, is engaged and reinforced by a wall of a mating housing so that movement of the resilient arm is limited in a direction away from the terminal and, in addition, side walls of the second housing are also protected and reinforced by side walls of the first housing so that the resilient arm is not bent or deformed even if a strong pulling force is applied to the terminal through the wire, thereby preventing the terminal from disengaging from the resilient arm. Furthermore, the invention is constructed so as to effectively utilize the otherwise useless space in the first housing so as to receive in the space the second housing, thereby providing a small-size connector assembly.

I claim:

1. An electrical connector assembly comprising a first connector having a first housing with spaced parallel side walls defining a terminal-receiving passageway therein and a terminal retained in the terminal-receiving passageway, said housing being provided with a resilient arm which is provided on one of the inner surfaces of the side walls and which projects into the terminal-receiving passageway, said arm having a free end which is adapted to hold the terminal in the terminal-receiving passageway, and a second connector having a second housing with spaced parallel sidewalls which can be fitted into the side walls of the first housing, said second connector having another terminal arranged between the side walls thereof to be connected to the terminal of the first connector, said terminals being electrically connected to each other when the second connector is mated with the first connector, characterized in that the resilient arm extends parallel to associated side wall on which the resilient arm is provided and is spaced from the associated wall to define a space for receiving one of the side walls of the second housing between the associated wall and the resilient arm to limit the movement of the resilient arm in a direction away from the terminal when the second connector is mated with the first connector.

2. An electrical connector assembly as set forth in claim 1, characterized in that the resilient arm has a latching projection that is disposed in recesses of adjacent contact arms of adjacent terminals.

3. An electrical connector assembly as set forth in claim 1, characterized in that the other of the side walls of the first housing has a terminal-supporting member provided on the other of the inner surfaces of the side walls on which a contact section of the terminal is supported, the terminal-supporting member extends parallel to and is spaced from the associated side wall on which the terminal-supporting member is formed to define a space for receiving the other of the side walls of the second housing.

4. An electrical connector assembly as set forth in claim 3, characterized in that outer surfaces of the side walls of the second housing and inner surfaces of the side walls of the first housing have matable projections and recesses to latch the housings together and to increase the retention forces on the terminal.

* * * * *